US005216201A

United States Patent [19]

Ohishi et al.

[11] Patent Number: 5,216,201

[45] Date of Patent: Jun. 1, 1993

[54] LIQUID ELECTROPHOTOGRAPHIC DEVELOPING DEVICE

[75] Inventors: Chikashi Ohishi; Chiaki Kawamoto; Hidefumi Sera; Sho Nakao, all of Shizuoka, Japan

[73] Assignee: Fuji Photo Film Co., Ltd., Kanagawa, Japan

[21] Appl. No.: 575,717

[22] Filed: Aug. 31, 1990

[30] Foreign Application Priority Data

Sep. 5, 1989 [JP] Japan ..... 1-229758

[51] Int. Cl.[5] ..... G03G 15/10

[52] U.S. Cl. ..... 118/650; 118/662; 118/648; 355/262; 355/256

[58] Field of Search ..... 118/650, 647, 662, 648; 355/262, 264, 261, 256

[56] References Cited

U.S. PATENT DOCUMENTS

| | | | |
|---|---|---|---|
| 3,673,985 | 7/1972 | Dois | 118/650 |
| 3,799,791 | 3/1974 | Kolibas | 118/662 X |
| 3,820,891 | 6/1974 | Kurakawa | 118/647 X |
| 3,871,329 | 3/1975 | Anemaet | 118/650 |
| 4,142,480 | 3/1979 | Schwandt et al. | 118/661 |
| 4,527,509 | 7/1985 | Richardson | 118/650 |
| 4,862,209 | 8/1989 | Sakamoto et al. | 355/211 |
| 4,893,151 | 1/1990 | Yamazaki et al. | 355/245 |
| 4,951,093 | 8/1990 | Ishii et al. | 355/245 |

FOREIGN PATENT DOCUMENTS

| | | | |
|---|---|---|---|
| 50-38943 | 12/1975 | Japan . | |
| 59-8832 | 2/1984 | Japan . | |
| 0156686 | 7/1987 | Japan | 355/215 |
| 0192769 | 8/1987 | Japan | 355/215 |
| 0192770 | 8/1987 | Japan | 355/215 |

*Primary Examiner*—R. L. Moses

*Attorney, Agent, or Firm*—Sughrue, Mion, Zinn, Macpeak & Seas

[57] ABSTRACT

A liquid electrophotographic developing device for developing a photoconductive material charged and exposed and which has a photoconductive layer formed on one surface of a conductive layer comprises a developing tank filled with a developing solution in which a developing electrode and a back electrode are disposed. The electrodes are immersed in the developing solution and disposed on either side of the photoconductive material in conveyance. The back electrode comes into contact with the back surface of the photoconductive material, whereas the developing electrode is spaced part from the photoconductive layer. Upon directly connecting the electrodes, toner particles contained in the developing solution adhere to the photoconductive layer to achieve development. The developing electrode does not touch the photoconductive layer, making a developed image free from soiling, the electrodes are immersed in the developing solution, preventing the drying and solidifying of the solution around the electrodes, and the developing tank is covered with a lid, preventing the vaporizing of the developing solution.

22 Claims, 6 Drawing Sheets

LIQUID ELECTROPHOTOGRAPHIC DEVELOPING DEVICE

BACKGROUND OF THE INVENTION

1. Field of the Invention

This invention relates to a liquid electrophotographic developing device for developing a photoconductive material charged and exposed by the use of a liquid toner.

2. Background Information

A liquid electrophotographic developing device is proposed to develop a photoconductive material (such as an electro-lithograph plate which is produced by forming a photoconductive layer made of ZnO and binder on a base material water-proofed and made conductive) which bears an electrostatic latent image after being charged and exposed to an image. Development is performed by applying a liquid toner to the photoconductive material so as to make the electrostatic latent image borne thereby visible.

Specifically, when two electrodes made of metallic plates and disposed in closely-spaced relation are directly connected together or when bias voltage is applied to the two electrodes in order to minimize fogging in the image, toner flowing between the two electrodes develops the photoconductive material which is also traveling between the two (developing and back) electrodes. In conventional developing devices, however, toner particles tend to electro-deposit on the two electrodes, especially on the back electrode, so that the photoconductive material is soiled upon contact with the electrodes during development. The contact of the photoconductive material with the electrodes has been avoided by increasing the distance between the developing electrode and the back electrode. However, if the distance between the electrodes is increased, the electric field between the developing electrode and the photoconductive material weakens, thereby lowering the efficiency of development which causes insufficient development resulting in visual images of poor reproducibility. An ordinary way to prevent the photoconductive material from being soiled is to stretch a wire material such as gut around the back electrode.

Japanese Patent Application Laid-Open No. 59-185373 teaches a liquid developing device in which a groove is formed in a back electrode. An insulating guide is then disposed between the back electrode and a photoconductive material, so that the photoconductive material is prevented from coming into contact with the back electrode so as to avoid the soiling of the photoconductive material.

In this prior art, however, when the back electrode is soiled and thus the efficiency of development is lowered, the developing device must be stopped to wash the back electrode. The work of washing toner from the back electrode is difficult in the case where a wire material such as gut is provided around the back electrode.

Japanese Patent Publication No. 50-38943 teaches a liquid developing device in which a liquid toner is caused to flow vigorously, so that a strong stream of liquid toner prevents the photoconductive material from coming in contact with the back electrode and washes off the toner adhering to the back electrode.

Japanese Patent Publication No. 59-8832 teaches a liquid developing device in which a liquid toner is vigorously introduced between the photoconductive material and the developing electrode and between the photoconductive material and the back electrode at flow speeds higher than the speed of the photoconductive material passing between the electrodes to prevent the photoconductive material from coming in contact with the metallic plates and to wash off the toner adhering to the back electrode.

In the liquid developing device taught in Japanese Patent Publication No. 50-38943, when development is carried out for a long time, toner particles adhere gradually to the back electrode disposed on the back side of the photoconductive material thereby soiling the back electrode. If the toner adheres to the back electrode, a non-conductive film is formed on the surface of the back electrode, so that the function of the electrode is deteriorated causing the efficiency of development to be lowered. Therefore, the proper amount of toner does not adhere to the photoconductive material and good development cannot be achieved; thus, the developing device must be stopped periodically to wash the back electrode.

In the liquid developing device taught in Japanese Patent Publication No. 59-8832, although the rate at which toner particles adhere to the back electrode can be decreased, the liquid toner adheres to the back electrode in long-term processing; thus, the back electrode must be washed as is the above case.

To solve the foregoing problems, Japanese Patent Application Laid-Open No. 1-260463 teaches a direct-powered developing system in which a conductor such as a brush is disposed so as to come into contact with the back surface of a photoconductive material, and to perform development, a liquid toner is supplied between the photoconductive material and the developing electrode under the condition that the conductor or back electrode and a base material of the photoconductive material are in direct contact. In this system, since toner particles never electro-deposit on the back electrode, the back electrode is perfectly prevented form being soiled through electro-deposition.

In this developing system, however, if the conductor is kept in a wet state or holds a developing solution adhering thereto for a long time (e.g. from the end of developing work to the beginning of developing the next day), the liquid toner adhering to the conductor dries and solidifies, so that a non-conductive coating is formed to lower the efficiency of development. To avoid such a defect, the developing electrode and the like must be washed after the end of the developing work or before the beginning of next development. This work is troublesome.

In this regard, Japanese Patent Application Laid-Open No. 64-38771 teaches a system in which to prevent soiling, a liquid toner is caused to continuously flow toward electrodes to prevent the drying and solidifying of the liquid toner in case a liquid developing device is to be stopped for a comparatively short time; or, a washing solution is caused to automatically flow in case the developing device is stopped for a long time. That is, to prefectly prevent the electrodes from being soiled by electro-deposition, drying and solidifying of the toner, a toner circulating means for short-term stoppage and an automatic washing means for long-term stoppage are incorporated in the direct-powered developing device.

However, in the liquid developing device taught in Japanese Patent Application Laid-Open No. 64-38771, the liquid toner flows toward the developing electrode even while development is not carried out. This results in a large degree of vaporization so that the concentration of the liquid toner varies. Specifically, the toner concentration varies largely between where a large volume of work is contiguously carried out and where a small volume of work is intermittently done; thus, the amount of toner adhering to the photoconductive material bearing an electrostatic latent image varies in long-term processing. Such a difference in toner concentration will be corrected by changing the concentration of a supplementary toner between contiguous large-volume processing and intermittent small-volume processing; but, this makes control complicated or non-practicable. Another system was taught in which with a toner of high concentration and a carrier solution prepared, they are automatically weighed and introduced in response to each measurement of the toner concentration to bring about a proper concentration; but, this system was rarely practiced because the device is complicated in structure and development is influenced due to the reliability of meters and the like.

As described above, in any of the conventional liquid developing devices and systems, toner particles adhere to the back electrode or the like, so that a non-conductive coating is formed to lower the efficiency of development; thus, the device must be washed frequently to recover an intended efficiency of development, making maintenance troublesome. On the other hand, in the method free of the above defects, the concentration of the liquid toner varies due to vaporization. That is, toner concentration varies between contiguous large-volume processing and intermittent small-volume processing to change a final quality. Consequently, a very complicated control must be incorporated to overcome the above.

SUMMARY OF THE INVENTION

It is an object of the present invention to provide a liquid electrophotographic developing device which can perfectly prevent the adhering of a toner to a back electrode and allow stable development for a long period of time irrespective of whether development is performed on a large-volume contiguous basis or on a small-volume intermittent basis without incorporating a complicated control unit.

To accomplish the foregoing object, a liquid electrophotographic developing device according to the present invention comprises a developing section or tank with a liquid toner stored therein in which a photoconductive material is inserted and from which it is fed out after being immersed in the liquid toner, a developing electrode disposed along the conveying path of the photoconductive material immersed in the liquid toner in confronting relation to the photoconductive surface of the photoconductive material, a back electrode disposed along the conveying path of the photoconductive material immersed in the liquid toner in confronting relation to the back surface of the photoconductive material, the photoconductive material coming in contact with the back surface of the photoconductive material, the two electrodes being directly connected together or applied with a bias voltage in order to minimize fogging in the image, and vaporization preventive means for sealing the developing section to prevent the vaporizing of a developing solution containing the liquid toner.

To perform development, the photoconductive material is inserted in the developing tank with the developing solution stored therein, so that the photoconductive material is immersed in the developing solution while being conveyed therethrough. During conveyance, the developing electrode facing the photoconductive surface of the photoconductive material and the back electrode held in contact with the back surface of the photoconductive material, the two electrodes are directly connected together, or a bias voltage is applied between two electrodes, so that the toner adheres to the photoconductive surface of the photoconductive material. The adhering of the toner to the photoconductive material makes an electrostatic latent image visible.

Since the back electrode is directly powdered, the toner does not adhere to the back electrode, and since it is immersed in the toner even while the device is not in operation, the toner does not dry, thus never bonds to the surface of the back electrode. Since the developing electrode is immersed in the toner even while the device is not in operation, the toner does not dry, thus never bonds to the surface of the developing electrode.

Since the whole device is sealed, the drying of squeeze rollers is suppressed, and sufficient squeezing occurs because there is no toner soil. Further, the toner does not dry and bond to the inner surface of the tank and the like. Therefore, dried toner never falls onto or adheres to the photoconductive material.

Since the liquid toner stored in the developing-solution tank is tightly sealed by the vaporization preventive means, there is little toner vaporization, or it is sufficient to add supplementary solution by an amount compatible with the quantity of processing of the photoconductive material; thus, the concentration of the toner is kept within a given range irrespective of whether development is performed on a large-volume contiguous basis or on a small-volume intermittent basis.

DESCRIPTION OF THE PREFERRED EMBODIMENTS

Figure 1:
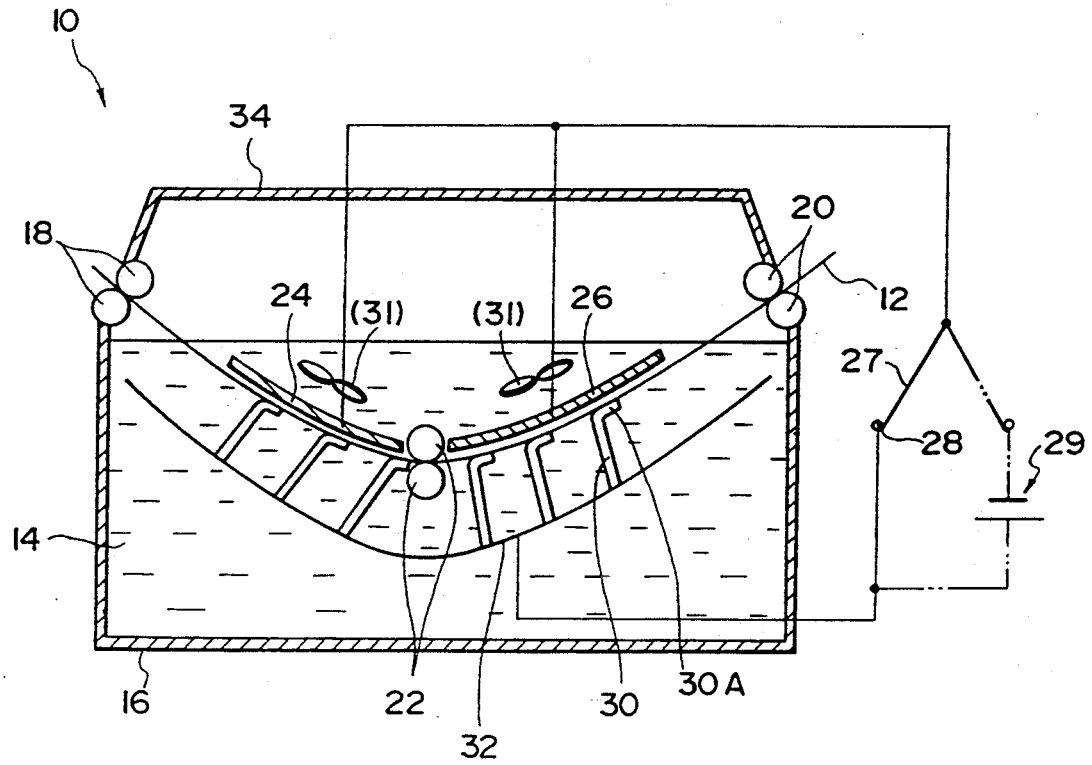
FIG. 1 is a vertical sectional view showing a first embodiment of a developing device according to the present invention.

FIG. 1 shows a first embodiment of a liquid electrophotographic developing device according to the present invention. This liquid Electrophotographic developing device 10 applies a toner 14 to a sheet-like photoconductive material 12 (produced by forming a photoconductive layer on a conductive base material) to develop an electrostatic latent image.

Specifically, the sheet-like photoconductive material 12 is produced by forming a photoconductive layer (made of Zno and a binder) on a base material (such as paper), made conductive and water-proofed. The sheet-like photoconductive material 12 is hereinafter referred to as master plate 12.

As shown in FIG. 1, a conveying roller pair 18 is provided at an upper lateral portion of a developing tank 16 in which the liquid toner 14 is stored. A squeeze/conveying roller pair 20 is provided in an opposite upper lateral portion of the development tank. Another conveying roller pair 22 is immersed in the liquid toner 14 stored in the developing tank 16. These conveying roller pairs 18, 20 and 22 are rotated by the driving force of driving means not shown so as to hold and convey the master plate 12. The convey roller pairs 18, 20 and 22 are made from an insulating material.

The master plate 12 bearing an electrostatic latent image after being charged and exposed is inserted between the conveying rollers 18, conveyed obliquely downward into the liquid toner 14 in the developing tank 16, and then inserted between the conveying rollers 22. The master plate 12 held between the conveying rollers 22 is then sent toward an upper lateral portion of the developing tank 16. The master plate 12 conveyed by the conveying roller pair 22 is inserted between the squeeze/conveying rollers 20 where the toner adhering to the master plate 12 is squeezed off, and then sent out from the developing tank 16. During the conveyance of the master plate 12 through the developing tank 16, the master plate 12 is immersed in the liquid toner 14.

A developing electrode 24 is provided above the conveying path of the master plate 12 and between the conveying roller pairs 18 and 22. Another developing electrode 26 is provided between the conveying roller pair 22 and the squeeze/conveying roller pair 20. Both electrodes are immersed in the liquid toner 14. The developing electrodes 24 and 26 face the photoconductive surface of the master plate 12 and extend in parallel with the conveying path of the master plate 12. The developing electrodes 24 and 26 are connected via lead wires and a switch 27 to a terminal 28. The developing electrodes 24 and 26 are made of wire mesh, a conductive plate, or the like.

A plurality of back electrodes 30 are provided at the lower side of the conveying path of the master plate 12, which are spaced apart in intervals of 10 mm in the widthwise direction (in the vertical direction in FIG. 2) and are immersed in the liquid toner 14. Each back electrode 30 is connected at one end to a base electrode 32. The other end 30A projects into the conveying path of the master plate 12. The base electrode 32 is connected via a lead wire to the terminal 28.

When the master plate 12 is inserted into the developing tank 16 and conveyed between the developing electrodes 26 and 24, the back surface (opposite to the photoconductive surface) of the master plate 12 is held in sliding contact with the distal end 30A of each back electrode 30. As a result, the developing electrodes 24 and 26 are short-circuited to the back electrodes 30, so that an electric field is generated between the developing electrode 24, 26 and the photoconductive surface of the master plate 12 to achieve development.

To prevent fog from arising in an image-free portion, as shown in FIG. 1, a power source 29 may be connected if necessary to apply a back bias voltage of many of volts between the developing electrodes 24 and 26 and the back electrodes 30.

Figure 2:
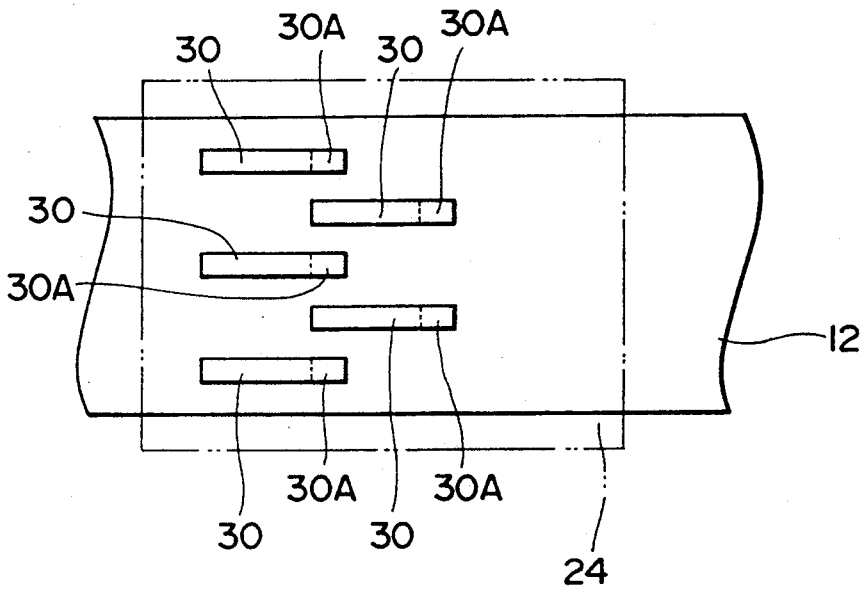
FIG. 2 is a plan view showing the relationship between a back electrode and a photoconductive material.

As shown in FIG. 2, the distal ends 30A of the back electrodes 30 are held in intermittent contact with the master plate 12 over the whole width thereof. It is preferable that a plurality of such back electrodes 30 be distributed at equal intervals of 20 mm or less, for example. Further, it is preferable that the contact means of each back electrode 30 in relation to the master plate 12 be bristle-like having an adequate resiliency to obtain reliable contact with the back surface of the master plate. Therefore, conductive materials, such as steel, stainless steel and carbon fiber, are adapted to form the electrode, and structural parameters, such as shape, width, length and attaching angle, may be changed to give an adequate resiliency to the electrode. In brief, it is sufficient that the electrode be conductive and have enough resiliency to follow the shift in the thicknesswise direction of the photoconductive material.

A lid 34 acting as vaporization prevention means is provided on the upper section of the development tank 12. This lid 34 tightly seals the developing tank 16 to prevent the liquid toner 14 stored in the developing tank 16 from coming in contact with the external air. Since the pair of conveying rollers 18 as well as the pair of squeeze/conveying rollers 20 are held in tight contact, the quantity of air flowing in between these roller sections is small. Therefore, the amount of vaporization of the liquid toner 14 stored in the developing tank 16 is very small.

The operation of the embodiment will be described.

The master plate 12 bearing an electrostatic latent image resulting from being treated in charging and exposing unit not shown is inserted between the conveying rollers 18, sent downward into the developing tank 16, conveyed through the liquid toner 14, and inserted between the developing electrode 24 and the back electrodes 30. The distal ends 30A of the back electrodes 30 slide on the back surface of the master plate 12 held between the developing electrode 24 and the back electrodes 30, so that an electric field is generated between the photoconductive surface and the developing electrode 24. By virtue of this electric field, toner particles contained in the liquid toner 14 adhere to the electrostatic latent image created on the surface of the master plate 12 and make the electrostatic latent image visible. Thus, the master plate 12 is developed.

After the conveying direction is changed by the conveying roller pair 22, the master plate 12 is inserted between the developing electrode 26 and the back electrodes 30, and thus, the master plate 12 is further developed. Next, the master plate 12 is inserted between the squeeze/conveying rollers 20 where the toner adhering to the master plate 12 is squeezed off, and then sent out from the developing tank 16.

In this way, the distal ends 30A of the back electrodes 30 in the embodiment contact directly with the back surface of the master plate 12 to perform development; therefore, toner particles do not adhere to the back electrode preventing a non-conductive coating from forming thereon. Efficiency of development is not decreased, whereby development can be achieved satisfactorily.

Further, since the developing electrodes 24 and 26 and the back electrodes 30 are immersed in the liquid toner 14 stored in the developing tank 16, the liquid toner adhering to the developing electrodes 24 and 26 and to the back electrodes 30 never dries and solidifies. And, since toner particles are not electro-deposited on the back electrodes 30, washing is not required, thereby simplifying maintenance.

Further, since the upper section of the developing tank 16 is tightly covered with a lid 34, the amount of vaporization of the liquid toner 14 is small, whereby the change in concentration of the liquid toner 14 can be suppressed. This increases the number of prints that can be handled by a given quantity of liquid toner 14.

The reason why the number of prints that can be handled by the liquid toner 14 will increased by covering the developing tank 16 with the lid 34 will be described.

Figure 6:
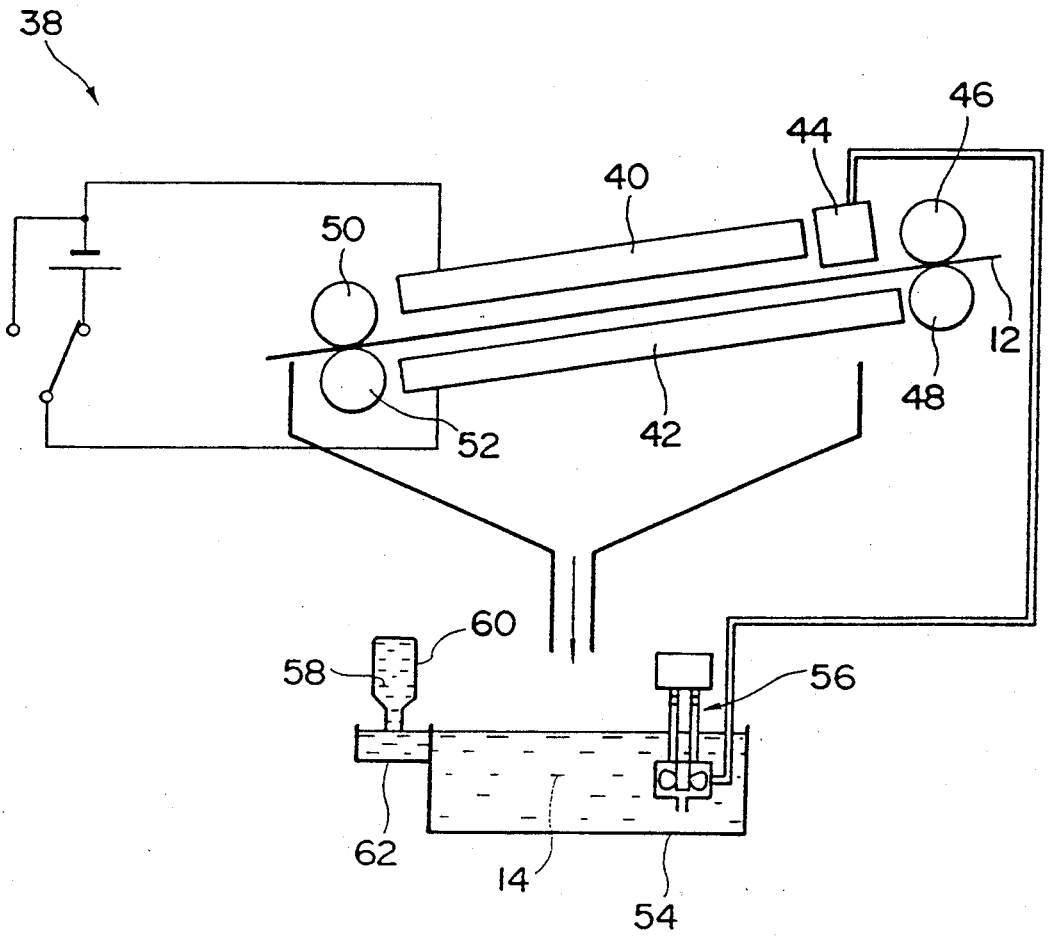
FIG. 6 PRIOR ART
FIG. 6 is a vertical sectional view showing a conventional developing device.

FIG. 6 shows a conventional liquid electrophotographic developing device 38 widely used in processing the master plate. This liquid electrophotographic developing device 38 has a developing electrode 40 and a back electrode 42, made of metallic plates, which are horizontally disposed in closely-spaced relation at an angle. An inlet section for the master plate 12 and the toner 14 is defined in an upper portion of the thus inclined electrodes, a toner supply head 44 is provided in the inlet section, and a pair of conveying rollers 46 and 48 is provided in front of the toner-supply head. An outlet section for the toner and the master plate 12 is defined in a rear portion of the inclined electrodes, and a pair of squeeze rollers 50 and 52 is provided at the rear of the outlet section.

The master plate 12 electrified and exposed is held between the convey rollers 46 and 48, sent through the gap between the electrodes 40, 42 where it is developed by the toner, pinched between the squeeze rollers 50 and 52 where excess toner adhering to the master plate is squeezed off, and then sent on to a next step (a fixing stage not shown).

The toner is drawn up from a toner tank 54 by a pump 56 and flows to the toner supply head 44 where the toner is spread uniformly over the whole width of the master plate. The excess toner drips off and returns to the toner tank 54.

A concrete example of the development processes performed using the conventional device will be described. The master plate was an ELP Regular Master Plate (ELP-1) made by Fuji Photo Film Co., Ltd. The liquid toner was ELP Toner (ELP-T1) made by the same company.

As shown in FIG. 6, a supplementary toner bottle 60 with a supplementary toner 58 stored therein was inverted in a pan 62 attached to the toner tank 54 such as in the case of a chicken feeder. The toner tank 54 was initially filled with 4 liters of toner, the supplementary toner 58 of the same concentration was set, and 500 prints per day were contiguously handled. The concentration of the liquid toner 14 decreased and weakened. About 3000 prints of 5% in image density were finished using the master plate 12 of 0.1 $m^2$ in size. After 4 supplementary toner bottles of 2 liters each were added, the amount of adherence of toner to the master plate 12 decreased. Additional prints could not be handled because of the decrease in printing ability necessary for the master plate 12. This was the limit of processing. The toner in the toner tank had to be replaced.

On the other hand, as an intermittent operation, 10 prints per day were handled using the same device. The amount of vaporization of the toner per print was large, as compared to the case of contiguous operation; thus, the concentration of the liquid toner 14 increased. After 2000 prints were finished, 8 liters of supplementary toner 58 corresponding to 4 supplementary bottles of 2 liters each were required. At this stage, the density of fogging in the image-free portion of the master plate increased. This tended to stain additional prints. That is, further processing could not be continued. The toner in the toner tank 54 had to be changed.

On the contrary, in the embodiment shown in FIG. 1, the upper section of the developing tank 16 is covered with the lid 34 to reduce the amount of vaporization of the liquid toner 14.

To practically perform development using the device of the embodiment, the developing tank 16 was filled with 4 liters of toner of the same concentration as the above. A toner having a concentration as high as three times the ordinary concentration was prepared as a supplement. 500 prints per day were handled on the one hand, 10 prints per day were handled on the other hand. In both cases, a total of 10000 prints were finished using 10 liters of supplementary toner. The result was that the master plate still had sufficient printing power and the finished prints virtually had no stains.

Figure 3:
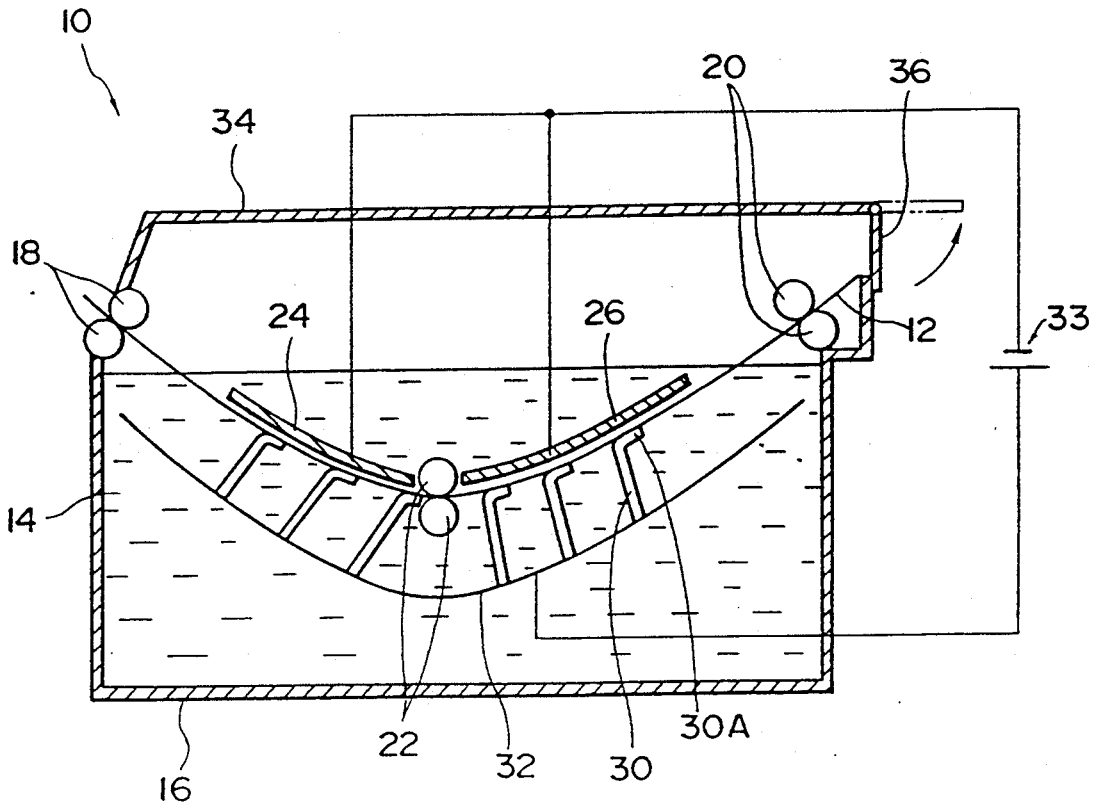
FIG. 3 is a vertical sectional view showing a second embodiment.

FIG. 3 shows a second embodiment of the present invention. Several components of the second embodiment identical with those of the first embodiment are designated by the same reference symbols as used in FIG. 1. Their description will be omitted.

As shown in FIG. 3, a shutter 36 is provided in an exit portion close to the squeeze/conveying roller pair 20 from which the master plate 12 is fed out. The shutter 36 is operated by the driving force of drive means not shown in such a manner that when the master plate 12 is sent out from the developing tank 16, the developing tank 16 opens as illustrated by the two-dot chain line in FIG. 3.

The shutter 36 normally shields the squeeze/conveying roller pair 30 from the exterior. Therefore, the developing solution coming from a lower section of the developing tank 16 and adhering to the squeeze/conveying roller pair 20 by virtue of the movement of the master plate 12 is prevented from drying and solidifying. Thus, the roller pair always performs its function of squeezing without requiring washing.

Although the foregoing embodiments have been described herein using the master plate 12 as the photoconductive material, other electrophotographic photoconductive materials can be developed by the liquid electrophotographic developing device 10 according to the present invention.

Although the foregoing embodiments have been described herein with the developing electrodes 24 and 26 disposed above the conveying path of the master plate 12 inside the developing tank 16 and the back electrodes 30 disposed below the conveying path, where the master plate 12 is conveyed with its photoconductive surface facing down, the developing electrodes 24 and 26 may be disposed below the conveying path of the master plate 12 and the back electrodes 30 above the conveying path.

Figure 4:
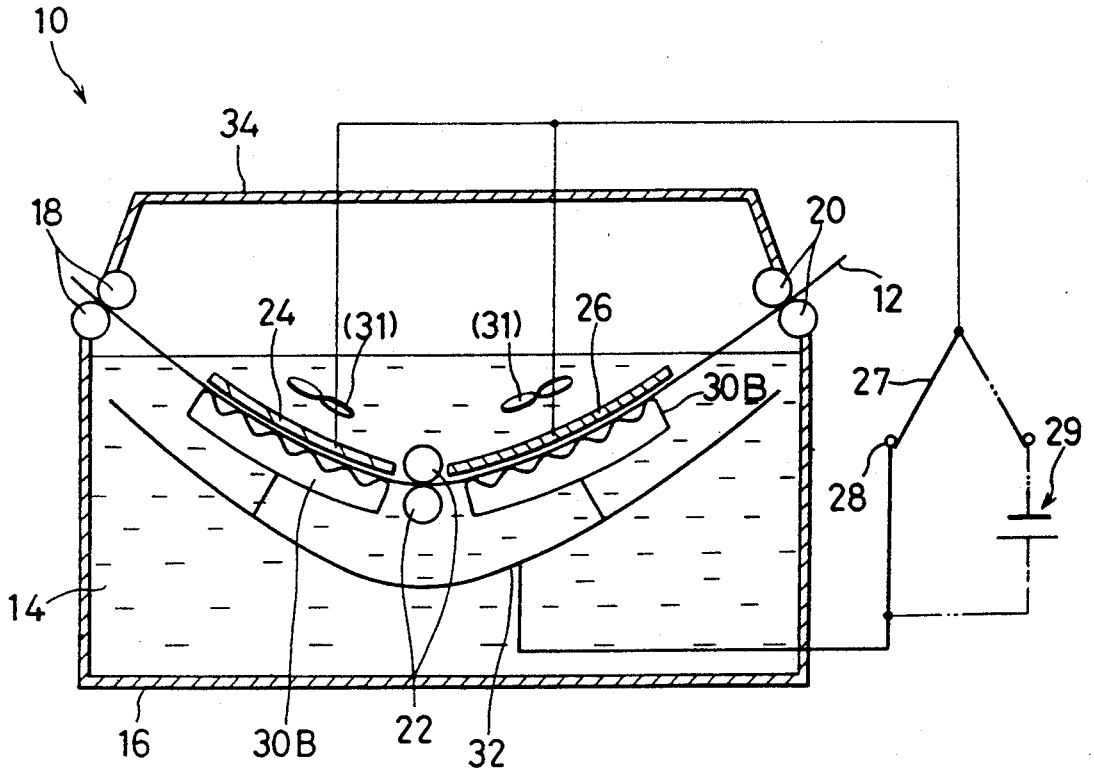
FIG. 4 is a vertical sectional view showing a third embodiment.

FIG. 4 shows a third embodiment of the present invention. In this embodiment, a back electrode 30B is made of a stainless plate, and its surface on the side of the master plate 12 is made rippled by embossing. The pitch of the rippled surface is 5 mm and the height of each protrusion is 2 mm, for example.

The solution is changed into a stream by an agitating vane 31, this stream of solution presses the master plate 12 against the back electrode 30B, and thus, the master plate moves while keeping its back surface in contact with the protrusions of the back electrode. Because each protrusion is made round at the top, the leading edge of the master plate 12 never hangs up.

Figure 5:
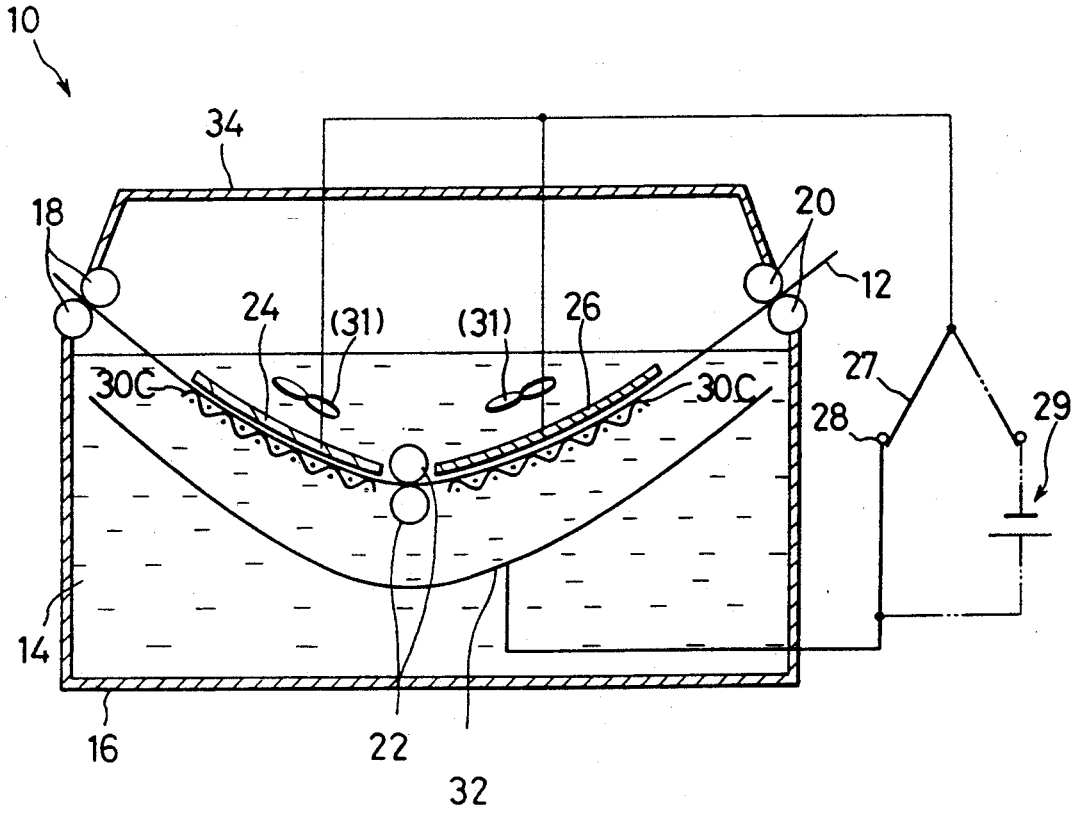
FIG. 5 is a vertical sectional view showing a fourth embodiment.

FIG. 5 shows a fourth embodiment of the present invention. In this embodiment, a back electrode 30C is made in the form of a conductive wire mesh so that the developing solution can pass through it. Similar to the third embodiment, the master plate 12 is pressed against the back electrode 30C by means of an agitating vane 31. The back electrode may be made of a metallic plate, such as a punching metal, having a number of through holes.

As described above, according to the present invention, the developing electrode and the back electrode are provided inside the developing tank with the developing solution stored therein and sealed by the vaporization preventive means. The photoconductive material is developed by being conveyed between these electrodes and immersed in the developing solution while keeping its back surface in contact with the back electrode; therefore, no soiling occurs because toner particles are not electro-deposited thereon and the toner is not dried nor solidified. This makes washing unnecessary and allows a number of master plates to be developed without demanding a change of toner irrespective of continuous or intermittent processing. With the foregoing prints of improvement, a long-term stable developing operation can be realized with no intervention of maintenance, and the number of prints able to be handled by a given quantity of liquid toner 14 can be increased.

An operation causing no soiling but requiring a change of solution many times cannot be called "long-term maintenance-free". Further, an operation requiring a change of solution a few times but demanding washing in the course of processing to remove soil also cannot be called "long-term maintenance-free". On the contrary, the liquid electrophotographic developing device according to the present invention satisfies the foregoing requirements and thus can be considered a long-term maintenance-free device.

What is claimed is:

1. A liquid electrophotographic developing device for developing a photoconductive material charged and exposed and which is made of a conductive base material with a photoconductive layer formed thereon by the use of a liquid toner functioning as a developing solution, comprising a developing section with the developing solution stored therein and into which the photoconductive material is fed and from which it is led out after being immersed in the developing solution, the photoconductive material being guided along a curved conveying path with the photoconductive surface being disposed on the inside of the conveying path, a developing electrode disposed in the developing solution in confronting relation to the photoconductive surface of the photoconductive material, and a back electrode disposed in the developing solution which comes into contact with the back surface of the photoconductive material, the back electrode including a plurality of back electrode elements disposed at equal intervals and contacting the outer back surface of the curved photoconductive material, wherein each of the plurality of back electrode elements is in the form of an arm including a root portion attached to a base electrode and an end portion projecting into the conveying path of the photoconductive material, the end portion of each back electrode element being curved so as to point toward the downstream side of the conveying path of the photoconductive material.

2. A developing device according to claim 1, wherein the plurality of back electrode elements are distributed at equal intervals over the whole width of the photoconductive material.

3. A developing device according to claim 1, wherein each back electrode element has resiliency.

4. A developing device according to claim 1, wherein the developing electrode is a wire mesh through which the toner of the developing solution can pass.

5. A developing device according to claim 1, further including means for pressing the photoconductive material against the back electrode.

6. A developing device according to claim 5, wherein the pressing means causes a stream of developing solution to press the photoconductive material against the back electrode.

7. A developing device according to claim 1, further including voltage applying means for applying a back bias voltage between the developing electrode and the back electrode.

8. A developing device according to claim 1, wherein the back electrode is a conductive body formed with a number of through holes.

9. A developing device according to claim 1, wherein the back electrode is in the form of a mesh.

10. The device of claim 1 further comprising vaporization prevention means for sealing the developing section to prevent the vaporizing of the developing solution.

11. A developing device according to claim 10, wherein the vaporization preventive means is a lid attached to the developing tank which covers the developing device inclusive of the developing tank but not a hold and conveying roller for the photoconductive material.

12. A developing device according to claim 11, wherein the lid is equipped with a shutter for opening the conveying path of the photoconductive material when the photoconductive material is to pass through it.

13. A developing device according to claim 12, further including a roller pair for holding the photoconductive material and squeezing out the developing solution adhering to the photoconductive material, which is provided in a photoconductive-material exit portion of the developing tank.

14. A liquid electrophotographic developing device for developing a photoconductive material charged and exposed and which is made of a conductive base material with a photoconductive layer formed thereon by the use of a liquid toner functioning as a developing solution, comprising a developing section with the developing solution stored therein and into which the photoconductive material is fed and from which it is led out after being immersed in the developing solution, the photoconductive material being guided along a curved conveying path with the photoconductive surface being disposed on the inside of the conveying path, a developing electrode disposed in the developing solution in confronting relation to the photoconductive surface of the photoconductive material, a back electrode disposed in the developing solution which comes into contact with the back surface of the photoconductive material, the back electrode including a plurality of back electrode elements disposed at equal intervals and contacting the outer back surface of the curved photoconductive material, and means for uniformly pressing the photoconductive material against the back electrode substantially along the entire length thereof, including a rotary vane disposed in the developing solution.

15. A liquid electrophotographic developing device for developing a photoconductive material charged and exposed and which is made of a conductive base material with a photoconductive layer formed thereon by the use of a liquid toner functioning as a developing solution, comprising a developing section with the developing solution stored therein and into which the photoconductive material is fed and from which it is led out after being immersed in the developing solution, a developing electrode disposed in the developing solution in confronting relation to the photoconductive surface of the photoconductive material, and a back electrode disposed in the developing solution which comes into contact with the back surface of the photoconductive material, wherein the back electrode is a conductive body whose surface is rippled.

16. The device of claim 15 further comprising vaporization prevention means for sealing the developing section to prevent the vaporizing of the developing solution.

17. A liquid electrophotographic developing device for developing a photoconductive material charged and exposed and which is made of a conductive base material with a photoconductive layer formed thereon by the use of a liquid toner functioning as a developing solution, comprising:

a developing section with the developing solution stored therein and into which the photoconductive material is fed and from which it is led out after being immersed in the developing solution, a developing electrode disposed in the developing solution in confronting relation to the photoconductive surface of the photoconductive material, and back electrode means, disposed in the developing solution and including a metallic plate formed with a number of ridges and recesses, for contacting the back surface of the photoconductive material with at least said ridges across an entire width of said photoconductive material.

18. The device of claim 17 further comprising vaporization prevention means for sealing the developing section to prevent the vaporizing of the developing solution.

19. A liquid electrophotographic developing method for developing a photoconductive material which is charged and exposed and is made of a conductive base material with a photoconductive layer formed thereon, by using a liquid toner functioning as a developing solution, comprising the steps of:

(a) supply an initial liquid toner having a first concentration to a developing section;

(b) feeding the photoconductive material to said developing section;

(c) disposing a photoconductive surface of the photoconductive material in confronting relation to the developing electrode;

(d) simultaneously contacting a back surface of the photoconductive material with a back electrode; and (e) supplying a replenishing liquid toner having a second concentration greater than said first concentration.

20. A liquid electrophotographic developing method of developing a photoconductive material according to claim 19, further comprising a step of:

(e) isolating the developing section from the atmosphere.

21. A liquid electrophotographic developing method of developing a photoconductive material according to claim 19, further comprising the steps of:

(f) supplying the liquid toner on the photoconductive surface of the photoconductive material through a toner supply head;

(g) collecting the liquid toner dropped from the photoconductive surface of the photoconductive material to a lower tank.

22. A liquid electrophotographic developing method of developing a photoconductive material according to claim 21, further comprising the steps of:

(h) supplying the first liquid toner into the tank, and subsequently supplying the replenishing liquid toner to the tank;

(i) circulating the liquid toner in the tank through the toner supply head to develop the photoconductive material.

* * * * *